US008248193B2

(12) United States Patent
Kaneda et al.

(10) Patent No.: US 8,248,193 B2
(45) Date of Patent: Aug. 21, 2012

(54) ELECTROMAGNETIC SWITCH FOR AUXILIARY-ROTATION STARTER

(75) Inventors: Naohito Kaneda, Chiyoda-ku (JP); Taehyun Kim, Chiyoda-ku (JP); Koichiro Kamei, Chiyoda-ku (JP); Noriaki Moriyama, Chiyoda-ku (JP); Mitsuru Tsukima, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 139 days.

(21) Appl. No.: 12/612,216

(22) Filed: Nov. 4, 2009

(65) Prior Publication Data

US 2010/0271155 A1 Oct. 28, 2010

(30) Foreign Application Priority Data

Apr. 28, 2009 (JP) ..... 2009-109341

(51) Int. Cl.
*H01F 7/08* (2006.01)

(52) U.S. Cl. ..... 335/126; 335/131

(58) Field of Classification Search ..... 335/126–131
See application file for complete search history.

(56) References Cited

U.S. PATENT DOCUMENTS

| | | | | |
|---|---|---|---|---|
| 5,563,563 | A * | 10/1996 | Freitas et al. | 335/126 |
| 5,892,194 | A * | 4/1999 | Uotome et al. | 218/68 |
| 6,911,884 | B2 * | 6/2005 | Uotome et al. | 335/132 |
| 6,914,504 | B2 * | 7/2005 | Kajino et al. | 335/126 |
| 7,852,178 | B2 * | 12/2010 | Bush et al. | 335/126 |
| 7,859,373 | B2 * | 12/2010 | Yamamoto et al. | 335/126 |
| 2006/0050466 | A1 * | 3/2006 | Enomoto et al. | 361/160 |

FOREIGN PATENT DOCUMENTS

JP 2005-163737 A 6/2005

* cited by examiner

*Primary Examiner* — Bernard Rojas
(74) *Attorney, Agent, or Firm* — Sughrue Mion, PLLC

(57) ABSTRACT

In an electromagnetic switch for an auxiliary-rotation starter according to the present invention, the magnetic bypass core is disposed at a place that is an air gap portion, in a magnetic circuit, through which the plunger moves due to magnetic attractive force produced by energizing the attraction coil and the holding coil and that is between the outer circumference of the plunger and the inner circumference of the bobbin, in such a way that one end thereof makes contact with one end of the case and the other end thereof faces the end of the core by the intermediary of an air gap.

5 Claims, 4 Drawing Sheets

ELECTROMAGNETIC SWITCH FOR AUXILIARY-ROTATION STARTER

BACKGROUND OF THE INVENTION

1. Field of the Invention

The present invention relates to an electromagnetic switch for an auxiliary-rotation starter for starting an engine.

2. Description of the Related Art

As a conventional electromagnetic switch for an auxiliary-rotation starter, there has been known an electromagnetic switch (refer to Japanese Patent Application Laid-Open No. 2005-163737) in which, as coil windings, there are utilized two kinds of coils, i.e., an attraction coil that produces magnetic attractive force to be exerted on a plunger coupled with a pinion gear by the intermediary of a lever and a holding coil that produces magnetic holding force for holding the plunger after it is attracted, and when the engine is started by the starter, auxiliary torque for making the starter motor slowly rotate is produced until the contact of the electromagnetic switch is closed, so that, at the same time when pushed out, the pinion gear is smoothly engaged with the ring gear through the auxiliary torque.

FIG. 3 illustrates a cross-sectional view of a conventional auxiliary-rotation starter. The overall configuration of a starter of this kind will be explained below with reference to the accompanying drawings. In FIG. 3, an auxiliary-rotation starter 1 that biases and starts an engine (unillustrated) is configured in such a way that the rotation speed of an armature 3 provided in a motor 2 is reduced by a deceleration unit 4 so that the torque of the armature 3 is raised, and then the motor 2 drives and rotates a pinion 7 that is mounted on an output shaft 6 by the intermediary of a clutch 5.

An electromagnetic switch 8 is integrated with the auxiliary-rotation starter 1; when an attraction coil 9 and a holding coil 10 of the electromagnetic switch 8 are energized, attractive force is exerted on a plunger 11 in a direction indicated by "A" in FIG. 3, and this attractive force makes a top end 12*a* and a bottom end 12*b* of a lever 12 engaged with the plunger 11 move leftward and rightward, respectively, in FIG. 3; therefore, the clutch 5, the output shaft 6, and the pinion 7 are biased to move rightward in FIG. 3. As a result, the pinion 7 moves in the axis direction so as to engage with a ring gear 13 of the engine.

FIG. 4 is an electric circuit diagram of a starting circuit; in FIG. 4, the auxiliary-rotation starter 1 is configured with the motor 2 and the electromagnetic switch 8. The positive electrode of a battery 31 is connected with a terminal 28 of the electromagnetic switch 8, and the negative electrode thereof is grounded. An auxiliary switch 32 that on/off-switches the supply of electric power to a terminal 30 of the electromagnetic switch 8 is provided with a terminal 33 connected with the battery 31, a terminal 34 connected with the terminal 30, and a coil 35 that on/off-controls connection between the terminal 33 and the terminal 34. One end terminal 36 of the coil 35 is connected with the positive electrode of the battery 31 via a key switch 37, and the other end terminal of the coil 35 is grounded.

In FIG. 4, when the key switch 37 is closed so as to start the engine, the coil 35 of the auxiliary switch 32 is energized and hence the terminal 33 and the terminal 34 are connected with each other, so that electric power is supplied from the battery 31 to the motor 2, via a first coil 15 and a second coil 16 of the attraction coil 9. At the same time, electric power is supplied to the holding coil 10 via the terminal 30. The holding coil 10 and the first and second coils 15 and 16 of the attraction coil 9 are energized; attractive force is exerted on the plunger 11; the plunger 11 moves in the "A" direction in FIG. 3, while compressing a restoring spring 26; then, the pinion 7 is moved toward the ring gear 13 (in the "B" direction), by the intermediary of the lever 12.

In this situation, after the pinion 7 and the ring gear engage with each other, the plunger 11 continues to move until it comes into contact with the endface of a core 18; a movable contact 25 makes contact with fixed contacts 28*a* and 29*a*; the motor 2 is directly energized by the battery 31 to produce normal rotation torque; then, the pinion 7 drives and rotates the ring gear 13, so that the engine is biased to start. When the movable contact 25 makes contact with the fixed contacts 28*a* and 29*a*, the electric potentials of the terminal 29 and the terminal 30 becomes approximately equal to each other; therefore, no current flows in the first and second coils 15 and 16 of the attraction coil 9, and only through the attractive force produced by the holding coil 10, the plunger 11 is held at a position where it makes contact with the endface of the core 18.

After the engine is started, opening the key switch 37 interrupts supply of electric power to the coil 35; the terminal 33 and the terminal 34 are disconnected from each other; thus, no voltage is applied to the terminal 30. Accordingly, no attractive force is produced by the holding coil 10; the restoring spring 26 restores the plunger 11 to its original state as illustrated in FIG. 3; then, due to the lever 12 engaged with the plunger 11, the pinion 7 is also released from the ring gear 13. At the same time the movable contact 25 is also restored to its original state as illustrated in FIG. 3; then, power supply to the motor 2 is ended.

The conventional auxiliary-rotation starter operates in such a manner as described above; the second coil 16 of the attraction coil 9 is wound around a bobbin 14 in the same direction as the holding coil 10 and the first coil 15 is wound around the bobbin 14 in a direction that is opposite to the direction in which the holding coil 10 and the second coil 16; therefore, even in the case where, for example, inertial rotation of the motor 2 produces a slight generation voltage at the terminal 29 when the movable contact 25 is restored to its original state as illustrated in FIG. 3 and hence a current flows in a series circuit that consists of the terminal 29, the second coil 16, the first coil 15, and the holding coil 10, no attractive force is exerted on the plunger 11, whereby the plunger 11 is securely restored to the original state as illustrated in FIG. 3.

For example, when viewed the series circuit from the terminal 29, the number of turns, in a downstream direction, of the first coil 15, the second coil 16, and the holding coil are 100, 20, and 80, respectively; the total number of turns of the second coil 16 and the holding coil 10 whose winding directions are the same is 100, and the number of turns of the first coil 15 whose winding direction is opposite to the winding direction of the second coil 16 and the holding coil 10 is also 100, and because these coils are in a series circuit, the same current flows in these coils; thus, magnetic fluxes are cancelled each other and hence no attractive force is produced, whereby the restoring spring 26 can rapidly restore the pinion 7 to the original state.

Next, in the case where an endface 7*a* of the pinion 7 and an endface 13*a* of the ring gear 13 make contact with each other but do not engage with each other, the contact between the endface 7*a* and the endface 13*a* stops the plunger 11 from moving in the "A" direction; due to attractive force, exerted on the plunger 11, that is caused through the energization of the holding coil 10 and the first and second coils 15 and 16 of the attraction coil 9, the endface 7*a* of the pinion 7 produces pressing force against the endface 13*a* of the ring gear 13 in the "B" direction. In this situation, the attractive force exerted on the plunger 11 is an attractive force that is a combination of the attractive force produced by the first and second coils 15 and 16 of the attraction coil 9 and the attractive force produced by the holding coil 10.

When viewed from the terminal 30, the winding directions of the first coil 15 and the second coil 16 of the attraction coil 9 are opposite to each other, and the winding directions of the first coil 15 of the attraction coil 9 and the holding coil 10 are the same; therefore, attractive force is exerted on the plunger 11 in such a way that the second coil 16 suppresses the attractive force produced by the first coil 15 and the holding coil 10.

In this situation, due to strong attractive force produced by a current flowing in the attraction coil 9, strong pressing force against the ring gear 13 is exerted on the pinion 7; therefore, the motor 2 is required to produce torque that is strong enough to make the pinion 7 rotate despite friction caused by the pressing force. It is conceivable that, in order to increase the torque of the opinion 7, the resistance value of the attraction coil 9 is reduced so that the current applied to the motor 2 is increased; however, when, in order to reduce the resistance value of the attraction coil 9, the wire diameter of the attraction coil 9 is increased without changing the number of turns thereof, the attractive force is further enlarged and hence the pressing force is also enlarged, whereby the effect obtained by increasing the torque of the pinion 7 is reduced.

when, in order to reduce the resistance value of the attraction coil 9, the number of turns the attraction coil 9 is decreased without changing the wire diameter thereof, the heat capacity of the attraction coil 9 is reduced and hence the heat resistance performance thereof is reduced; additionally, due to the reduction of the number of turns of the attraction coil 9, the specification of the holding coil 10 is also required to be changed. When the attractive force exerted on the plunger 11 is suppressed so as to reduce the pressing force and the resistance value of the attraction coil 9 is increased so as to facilitate the rotation of the pinion 7, the current applied to the motor 2 is reduced and hence the torque of the motor 2 is reduced, whereby the torque of the pinion 7 is reduced. In the case where the torque of the pinion 7 is reduced and there exists an abrasion or a scratch in the pinion 7 or the ring gear 13, it may be conceivable that the pinion 7 does not rotate and hence does not engage with the ring gear 13; therefore, because it is required to give the pinion 7 considerable amount of torque, it is not desirable to excessively increase the resistance value of the attraction coil 9.

Additionally, the attractive force produced by the attraction coil 9 is, for example, ten or more times as large as the attractive force produced by the holding coil 10; therefore, heat generated by the attraction coil 9 is larger than that generated by the holding coil 10. In the example, the number of turns of the first coil 15 is 100 and the number of turns of the second coil 16 whose winding direction is opposite to the winding direction of the first coil 15 is 20, and the first and second coils are connected in series; thus, for example, compared with a case where the attraction coil 9 is formed only of the first coil 15 of the same wire diameter and the number of turns thereof is 120, the resistance value of the attraction coil 9 is the same and hence the torque of the pinion 7 and the heat resistance performances of the attraction coil 9 are not deteriorated, and the attractive force becomes $^{80}/_{120}$, i.e., $^{2}/_{3}$, whereby the pressing force can be reduced; therefore, the pinion 7 can readily rotate.

In this situation, in the case where the endface 7*a* of the pinion 7 and the endface 13*a* of the ring gear 13 make contact with each other and do not engage with each other, due to the attractive force exerted on the plunger 11, pressing force that presses the ring gear 13 (in the "B" direction in FIG. 3) is exerted on the pinion 7; in this situation, because the motor 2 connected in series with the attraction coil 9 is supplied with electric power via the attraction coil 9 and generates torque, the torque is exerted on the pinion 7; therefore, when the pinion 7 rotates and engages with the ring gear 13, the motor 2 is supplied with electric power in a normal manner without intermediary of the attraction coil 9, and then the auxiliary-rotation starter 1 pinion 7 biases and starts the engine.

However, in the foregoing conventional configuration, it is required to make a current, which strikes a good balance between magnetic attractive force exerted on the plunger and auxiliary torque of the starter motor, flow in the attraction coil 9; therefore, when an auxiliary rotation current is enlarged in order to secure auxiliary torque, not only the magnetic attractive force is enlarged, but also the pressing force exerted on the pinion gear is enlarged, whereby, in the case of a large-capacity engine or a vehicle equipped with an idling stop system that causes the frequency of starting to increase, damage to the pinion gear or the ring gear is eventually enlarged.

Therefore, in order to change the winding specification without changing the auxiliary rotation current and to reduce the ampere-turn amount without lowering the electric resistance of the attraction coil, the wire diameter of the attraction coil is increased so as to enlarge the number of turns, and there is utilized a low-attraction-force specification in which opposite-direction winding is implemented.

In an electromagnetic switch for an auxiliary-rotation starter, according to the conventional technology, it is required to make an auxiliary rotation current, which strikes a good balance between magnetic attractive force exerted on the plunger and auxiliary torque of the starter motor, flow in the attraction coil; therefore, because of securing the auxiliary torque, not only the magnetic attractive force is enlarged, but also the pressing force exerted on the pinion gear is enlarged, whereby damage to the pinion gear or the ring gear is eventually enlarged.

With regard to the low-attraction-force specification, it is required to change the winding specification without changing the auxiliary rotation current; therefore, it is required to decrease the wire diameter of the coil and the number of turns in order to reduce the ampere-turn amount without lowering the coil resistance, or it is required to increase the wire diameter of the coil so as to increase the number of turns and to implement opposite winding. There has been a problem that, in the case where the wire diameter of the coil is decreased, the volume of the conductor is reduced and hence the heat resistance performance is deteriorated because the auxiliary rotation current does not change, and in the case where the wire diameter is increased, the volume of the conductor is enlarged and hence the winding space is expanded, whereby the assembling productivity is deteriorated.

SUMMARY OF THE INVENTION

An electromagnetic switch for an auxiliary-rotation starter according to the present invention includes a case that serves as the outer frame of the electromagnetic switch and forms a magnetic circuit, a core fixed on one end of the case, a plunger that faces the core by the intermediary of an air gap and protrusively moves from the other end of the case, and a bobbin that is disposed inside the case in such a way as to enclose part of the core and the plunger and around which an attraction coil and a holding coil are wound; the electromagnetic switch is characterized in that a magnetic bypass core for bypassing part of magnetic flux that is emitted from the plunger and heads for the core is disposed in a place that is inside part of the bobbin and in which no contact thereof with the plunger is made.

According to the present invention, part of magnetic flux for producing magnetic attractive force that makes the plunger move toward the core flows from the magnetic bypass core to the core via the air gap 13; therefore, even in the case of a conventional ampere-turn electromagnetic switch in which no opposite winding is provided, magnetic attractive force exerted on the plunger and pressing force of the pinion gear against the ring gear are reduced. As a result, there can be obtained an auxiliary-rotation starter that is superior in the engagement between the pinion gear and the ring gear and that has a high engagement durability and a high productivity.

The foregoing and other object, features, aspects, and advantages of the present invention will become more apparent from the following detailed description of the present invention when taken in conjunction with the accompanying drawings.

DETAILED DESCRIPTION OF THE PREFERRED EMBODIMENTS

Embodiment 1

Figure 1:
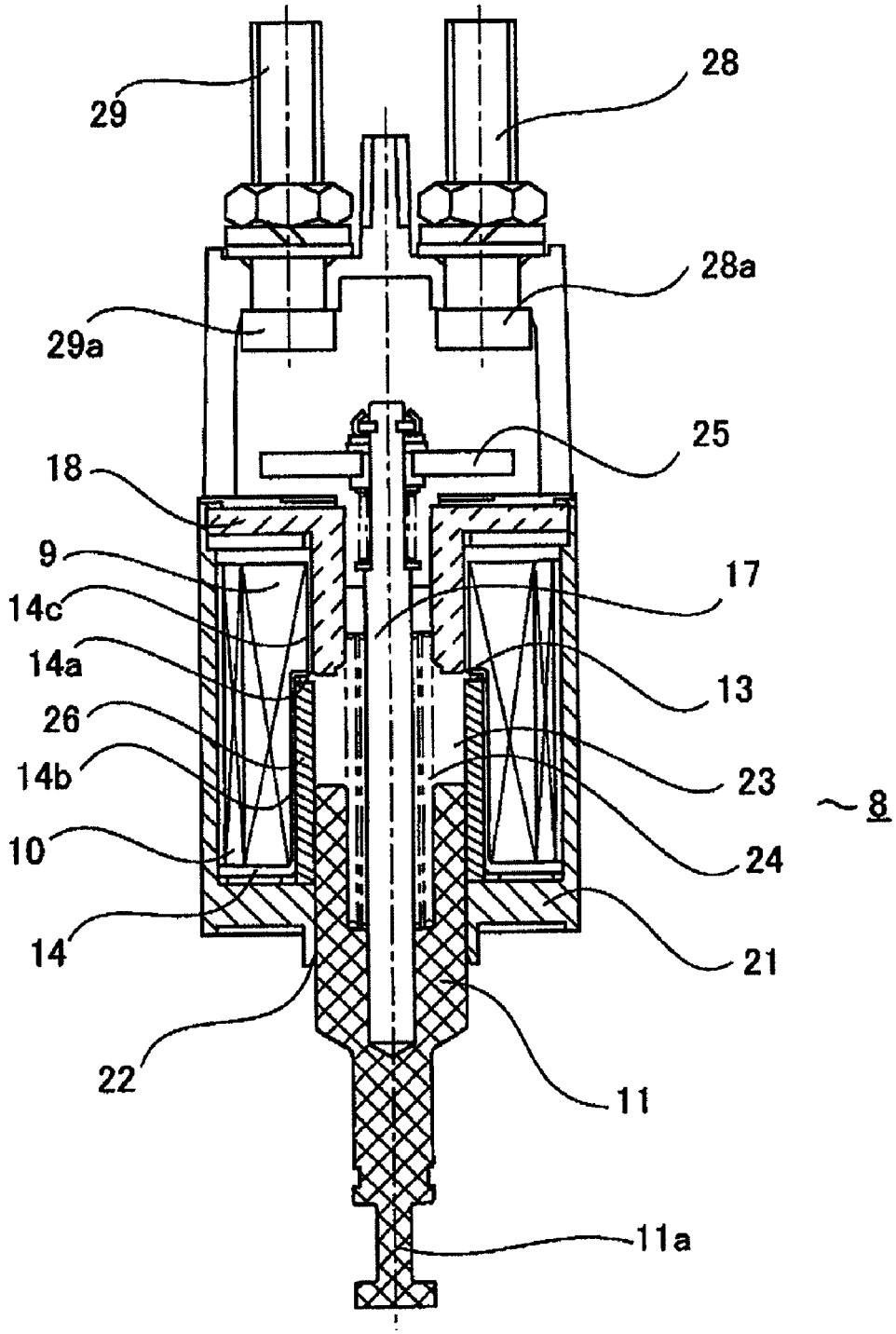
FIG. 1 is a cross-sectional view of the electromagnetic switch for an auxiliary-rotation starter according to Embodiment 1 of the present invention.

FIG. 1 is a structural view illustrating the electromagnetic switch for an auxiliary-rotation starter according to Embodiment 1 of the present invention.

An electromagnetic switch 8 in FIG. 1 is configured with a case 21 that serves as the outer frame of the electromagnetic switch 8 and forms a magnetic circuit, a core 18 fixed on one end of the case 21, a plunger 11 that faces the core 18 by the intermediary of an air gap 23 and protrusively moves from the other end of the case 21, and a bobbin 14 that is disposed in the case 21 in such a way as to enclose part of the core 18 and the plunger 11 and around which an attraction coil 9 and a holding coil 10 are wound.

An electromagnetic switch for an auxiliary-rotation starter according to the present invention is characterized in that a magnetic bypass core 26 for bypassing part of magnetic flux that is emitted from the plunger 11 and heads for the core 18 is disposed in a place that is inside part of the bobbin 14 and in which the magnetic bypass core 26 does not make contact with the plunger 11. The bobbin 14 is a radially-stepped type; the inner diameter thereof changes once at a stepped portion 14*a* formed in the vicinity of the end portion of the core 18. In other words, the bobbin 14 is formed of a large-diameter portion 14*b* that serves as a recess for containing the radial thickness of the magnetic bypass core 26 at the rear end of the case 21 and a small-diameter portion 14*c* that makes contact with the outer circumference of the core 18. The magnetic bypass core 26 is formed of a cylindrical magnetic material; in order to secure an air gap 22 between the outer circumference of the plunger 11 and the magnetic bypass core 26 and to form an air gap 13 between the core 18 and the magnetic bypass core 26, the magnetic bypass core 26 is disposed at a place that is inside the bobbin 14 around which the attraction coil 9 and the holding coil 10 are wound and that is in the vicinity of the outer circumference of the plunger 11 in such a way that one end thereof makes contact with the rear end of the case 21 and the other end thereof faces the end of the core 18 by the intermediary of the air gap 13. That is to say, the magnetic bypass core 26 is configured in such a way that the circumferential position thereof is determined by the inner circumference of the bobbin 14 and in such a way as to be pressed and fixed to the inner rear end of the case 21 by the stepped portion 14*a* of the bobbin 14. The radial thickness of the magnetic bypass core 26 is made to be 5% to 20% of the diameter of the plunger 11.

Figure 4:
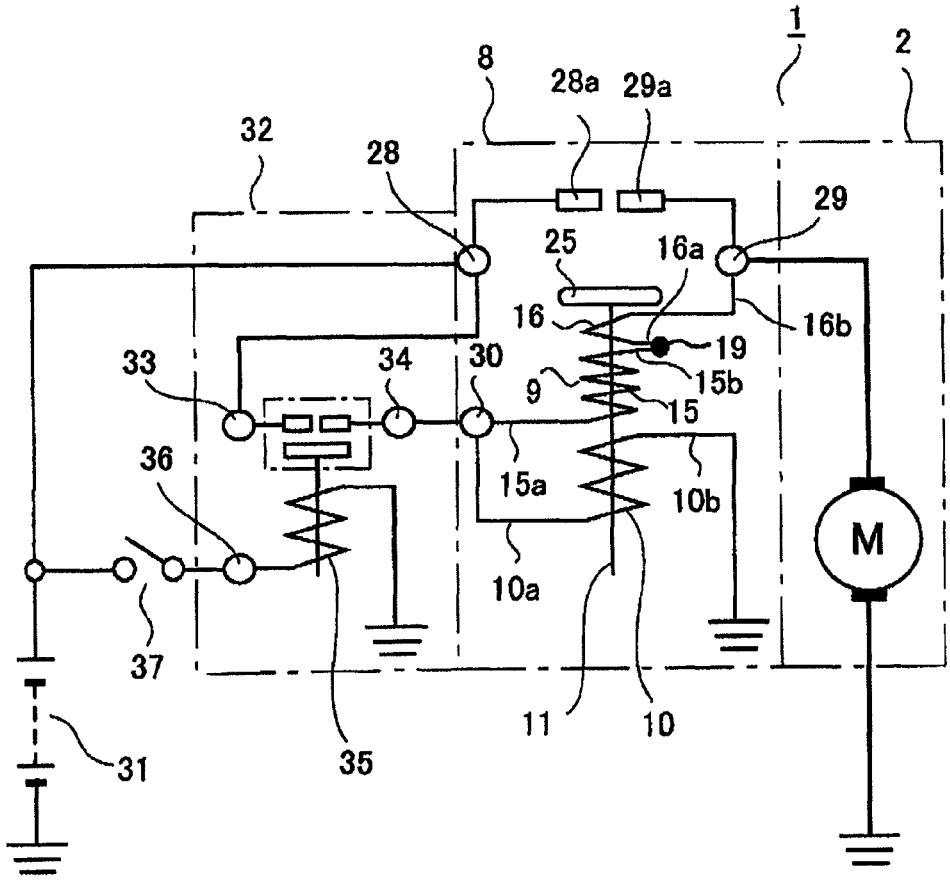
FIG. 4 PRIOR ART
FIG. 4 is an electric circuit diagram of the starting circuit of a conventional auxiliary-rotation starter.

Next, the operation of an electromagnetic switch for an auxiliary-rotation starter according to the present invention will be explained with reference to FIG. 4, i.e. the electric circuit diagram utilized for explaining the conventional device. When the key switch 37 is closed so as to start the engine, electric power is supplied from the battery 31 to the attraction coil 9 and the holding coil 10 of the electromagnetic switch 8. The current that has flown in the holding coil 10 heads for the body ground, and the current that has flown in the attraction coil 9 is supplied to the starter motor 2 via the terminal 29, so that auxiliary torque is given to the motor 2.

When electric power is supplied to the attraction coil 9 and the holding coil 10, magnetic flux is produced in a magnetic path that starts from and returns to the core 18 through the case 21, the air gap 22, the plunger 11, and the air gap 23 in that order and in a magnetic path that ramifies from the case 21 and returns to the core 18 through the magnetic bypass core 26 and the air gap 13 in that order; due to the effect of magnetic attractive force produced between the plunger 11 and the core 18, the plunger 11 moves toward the core 18; as the plunger moves, the pinion gear 7 connected with a rear end 11*a* of the plunger 11 by the intermediary of the lever 12 moves in the axis direction; then, due to the auxiliary torque, the pinion gear 7 and a teeth 13*a* of the ring gear 13 engage with each other.

Its engagement further presses out the pinion 7 and the plunger 11 further moves toward the core 18; then, the movable contact 25 provided at the front end of a rod 17 fixed to the plunger 11 electrically connects the fixed contact 28*a* of the terminal 28 connected with the battery 31, as an external power source, with the fixed contact 29*a* of the terminal 29. When the terminal 28 and the terminal 29 are electrically connected, electric power in the attraction coil 9 is cancelled; the driving current for the starter motor 2 is supplied to the starter motor 2 from the battery 31 through the terminal 28, the movable contact 25, and the terminal 29; then, cranking for starting the engine is performed.

Figure 3:
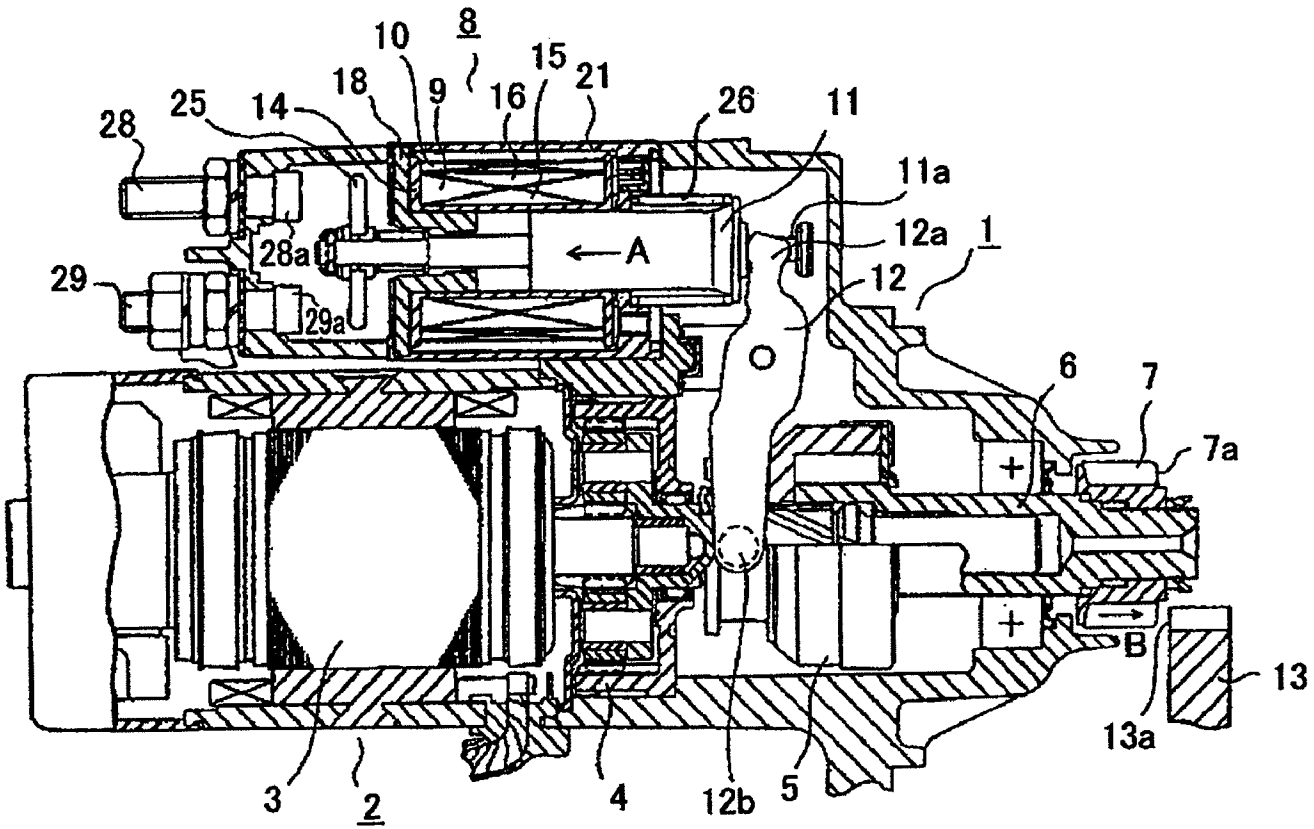
FIG. 3 PRIOR ART
FIG. 3 is an overall configuration view of a conventional auxiliary-rotation starter.

According to the foregoing configuration, in the conventional electromagnetic switch for an auxiliary-rotation starter illustrated in FIG. 3, part of magnetic flux flowing from the plunger 11 to the core 18 via the air gap 23 separates from the rest at the case 21 and reaches the core 18 via the magnetic bypass core 26 and the air gap 13; therefore, without changing the coil specifications, i.e., the resistance values of or winding methods for the attraction coil 9 and the holding coils 10, the magnetic attractive force exerted on the plunger 11 can be reduced while securing the auxiliary rotation current and the auxiliary torque.

Moreover, it is made possible that, after the plunger 11 makes contact with the core 18, the same or larger holding force can be secured; therefore, there can be obtained a low-cost, high-assembly-efficiency electromagnetic switch 8, for an auxiliary-rotation starter, that has a high engagement durability such that damage to the ring gear and the pinion gear is significantly reduced. The radial thickness of the magnetic bypass core 26 is made to be 5% to 20% of the diameter of the plunger 11; therefore, it can be prevented that the magnetic bypass core 26 is too thin to fulfill the function of a magnetic bypass or so thick that the magnetic switch becomes large-size.

Still moreover, due to the magnetic bypass core 26, the air gap 13 is formed between the magnetic bypass core 26 and the core 18, and by freely setting the air gap 13, the magnetic attractive force exerted on the plunger 11 can freely be controlled; therefore, there can be provided an electromagnetic switch, for an auxiliary-rotation starter, that has a far better engagement durability.

Furthermore, the circumferential position and the axial position of the magnetic bypass core 26 are determined by the bobbin 14; therefore, there can be provided a low-cost, high-assembly-efficiency electromagnetic switch, for an auxiliary-rotation starter, in which the number of components is reduced.

Embodiment 2

Figure 2:
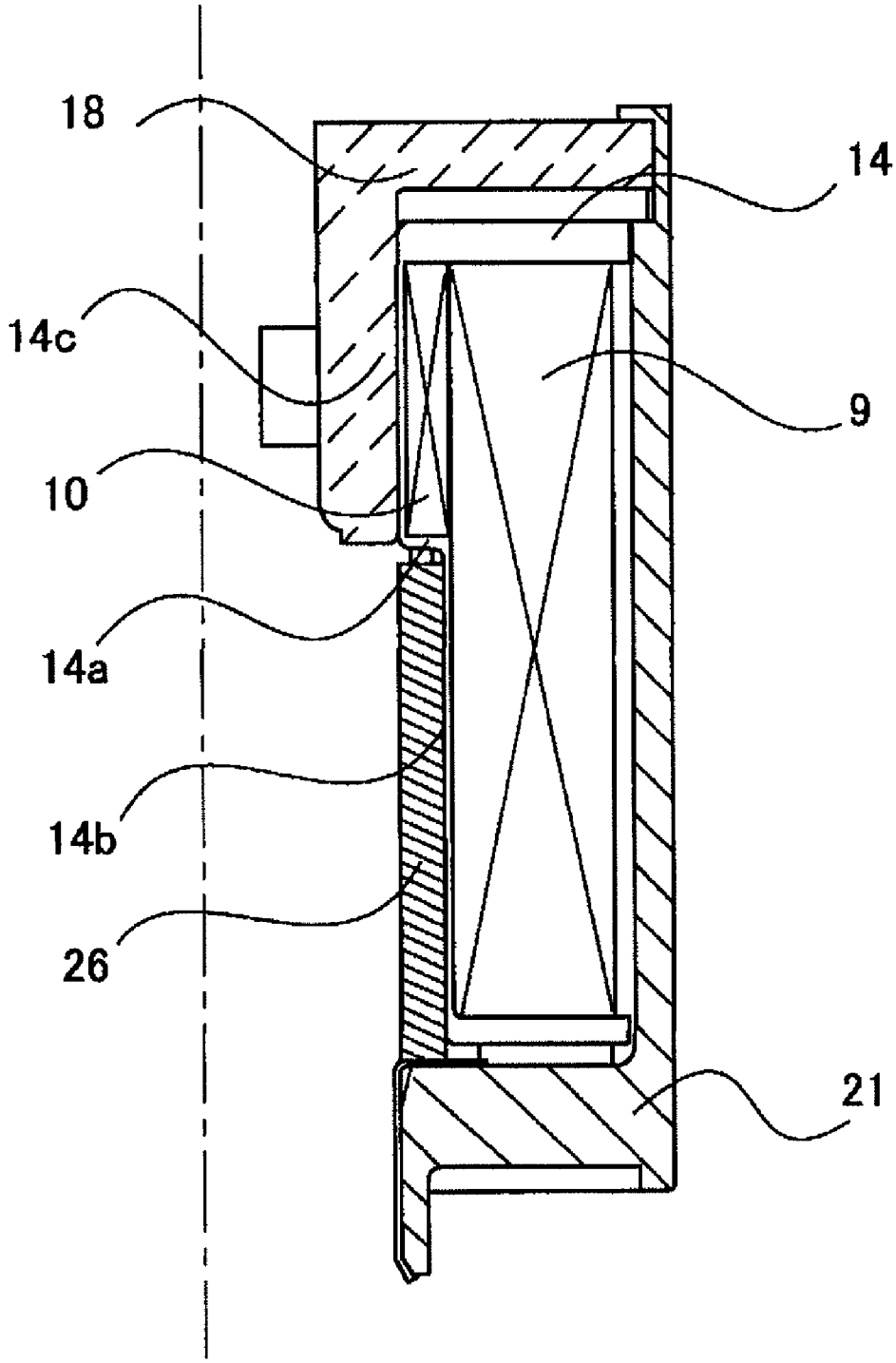
FIG. 2 is a partial cross-sectional view illustrating the winding structure of an electromagnetic switch according to Embodiment 2 of the present invention.

FIG. 2 is a partial configuration view of a coil according to Embodiment 2 of the present invention. In FIG. 2, the holding coil 10 is wound only around the small-diameter portion 14*c* in the stepped portion 14*a* of the bobbin 14; the level difference between the large-diameter portion 14*b* and the winding circumference of the holding coil 10 is the same as or smaller than half of the coil diameter of the attraction coil 9; the attraction coil 9 is wound in an aligned manner in a space ranging from the outer circumference of the holding coil 10 to the large-diameter portion 14*b* of the bobbin 14.

The foregoing configuration makes it possible to utilize the space inside the magnetic switch without loss and to facilitate the winding of the holding coil 10 and the attraction coil 9; therefore, there can be provided a low-cost, high-assembly-efficiency electromagnetic switch, for an auxiliary-rotation starter, that has a high engagement durability such that damage to the ring gear and the pinion gear is significantly reduced.

Various modifications and alterations of this invention will be apparent to those skilled in the art without departing from the scope and spirit of this invention, and it should be understood that this is not limited to the illustrative embodiments set forth herein.

What is claimed is:

1. An electromagnetic switch for an auxiliary-rotation starter, comprising:

a case that serves as the outer frame of the electromagnetic switch and forms a magnetic circuit;

a core fixed on one end of the case;

a plunger that faces the core by the intermediary of an air gap and protrusively moves from the other end of the case; and a bobbin that is disposed inside the case in such a way as to enclose part of the core and the plunger and around which an attraction coil and a holding coil are wound, wherein a magnetic bypass core for bypassing part of magnetic flux that heads for the core from the plunger is disposed inside part of the bobbin so as to secure an air gap between the outer circumference of the plunger and the magnetic bypass core, and to secure another air gap between the core and the magnetic bypass core, wherein a core side end of the magnetic bypass core is disposed closer to the core than a core side end of the plunger.

2. The electromagnetic switch for an auxiliary-rotation starter according to claim 1, wherein the magnetic bypass core is disposed in an air gap portion, in a magnetic circuit, through which the plunger moves due to magnetic attractive force produced by energizing the attraction coil and the holding coil and that is between the outer circumference of the plunger and the inner circumference of the bobbin, in such a way that one end thereof makes contact with one end of the case and the other end thereof faces the end of the core by the intermediary of an air gap.

3. The electromagnetic switch for an auxiliary-rotation starter according to claim 1, wherein the bobbin is configured in such a way as to be radially-stepped, and the magnetic bypass core is contained in a large-diameter portion of the stepped bobbin.

4. The electromagnetic switch for an auxiliary-rotation starter according to claim 3, wherein the position of the magnetic bypass core is determined by the inner diameter of the bobbin, and the magnetic bypass core is pressed by the stepped portion of the bobbin in such a way as to make contact with the inner end of the case.

5. The electromagnetic switch for an auxiliary-rotation starter according to claim 3, wherein the holding coil is wound in the small-diameter portion of the bobbin, and the attraction coil is wound in an aligned manner in the large-diameter portion of the bobbin that determines the positions of the outer circumferences of the holding coil and the magnetic bypass core.

* * * * *